US005926911A

United States Patent [19]

Chen

[11] Patent Number: 5,926,911

[45] Date of Patent: Jul. 27, 1999

[54] SHOCK ABSORBING HANDLE GRIP FOR TOOL HANDLE

[76] Inventor: John Chen, 2F-1, No. 51, Sec. 3, Chung Yang Rd., Lung Ching Hsiang, Taichung Hsien, Taiwan

[21] Appl. No.: 09/121,660

[22] Filed: Jul. 24, 1998

Related U.S. Application Data

[63] Continuation-in-part of application No. 08/881,002, Jun. 23, 1997, Pat. No. 5,845,364.

[51] Int. Cl.[6] ..... A47B 95/02

[52] U.S. Cl. ..... 16/111 R; 16/110 R; 16/DIG. 18; 16/DIG. 41; 81/177.1; 81/489; 81/22

[58] Field of Search ..... 16/111 R, 110 R, 16/DIG. 12, DIG. 19; 74/551.9; 81/177.1, 489, 20, 21, 22; 7/143, 167; 173/162.2

[56] References Cited

U.S. PATENT DOCUMENTS

| | | | |
|---|---|---|---|
| 4,738,166 | 4/1988 | Yamaguchi | 81/22 |
| 5,280,739 | 1/1994 | Liou | 81/22 |
| 5,588,343 | 12/1996 | Rust et al. | 81/20 |
| 5,713,104 | 2/1998 | Giampaolo, Jr. | 16/114 R |
| 5,845,364 | 12/1998 | Chen | 16/111 R |

*Primary Examiner*—Chuck Y. Mah
*Attorney, Agent, or Firm*—Bacon & Thomas, PLLC

[57] ABSTRACT

A shock absorbing handle grip includes a sleeve-like rubber grip body sleeved onto the coupling shaft of the handle of a hand tool, a substantially U-shaped flat packing bar inserted from a rear end opening on the grip body and clamped on the coupling shaft of the handle of the hand tool and an end cap fastened to the rear end opening of the grip body, the end cap, the grip body and the packing bar forming an air bag around the coupling shaft of the handle of the hand tool.

6 Claims, 3 Drawing Sheets

SHOCK ABSORBING HANDLE GRIP FOR TOOL HANDLE

The present invention is a continuation in part of a hand tool handle with shock absorbent airbag, under Ser. No. 08/881,002, filed Jun. 23, 1997, now U.S. Pat. No. 5,845,364, and relates to an improved structure of a shock absorbing handle grip for tool handle which comprises a rubber grip body sleeved onto the coupling shaft of the handle of a hand tool, a packing bar mounted in the grip body and coupled to the coupling shaft of the handle of the hand tool and an end cap fastened to the grip body and forming with the grip body and the packing bar an air bar around the coupling shaft of the handle of the hand tool.

BACKGROUND OF THE INVENTION

The handle of a regular hand tool is generally covered with a rubber grip for the holding of the hand comfortably. U.S. Pat. No. 5,588,343 discloses a shock absorbing tool handle design in which the rear coupling portion of the tool handle terminates into two endpieces separated by a slot. According to U.S. Pat. No. 5,490,437, the handle grip has a bore hole, and an end cap is fastened to the rear end opening of the handle grip. However. this design is still not satisfactory in function because the end cap tends to be forced out of the handle grip. According to U.S. Pat. No. 5,280,739, the handle grip has two holes respectively coupled to two bars of the shaft of the tool handle. The design of U.S. Pat. No. 4,738,166 discloses a handle grip with holes. This design does not provide an air tight structure to buffer shocks.

SUMMARY OF THE INVENTION

According to one aspect of the present invention, the shock absorbing handle grip comprises a rubber grip body coupled to the coupling shaft of a tool handle, the grip body comprising a longitudinal through hole through front and rear ends thereof, which receives the coupling shaft of the hand tool, a rear end opening at a rear end thereof, and two longitudinal sliding grooves longitudinally disposed on the inside along two opposite sides of the longitudinal through hole, and a substantially U-shaped flat packing bar inserted from the rear end opening into the longitudinal sliding grooves of the grip body and forming with the grip body an air bag around the coupling shaft of the tool handle, the packing bar comprising a transversely extended base stopped at one end of the coupling shaft of the tool handle, and two longitudinally extended flat arms respectively perpendicularly extended from two opposite ends of the base and respectively inserted into the longitudinal sliding grooves inside the grip body and respectively clamped on two opposite long sides of the coupling shaft of the tool handle. According to another aspect of the present invention, an end cap is fastened to the grip body by a split bolt and a holding down cap to seal the rear end opening of the grip body.

DETAILED DESCRIPTION F THE PREFERRED EMBODIMENT

Figure 1:
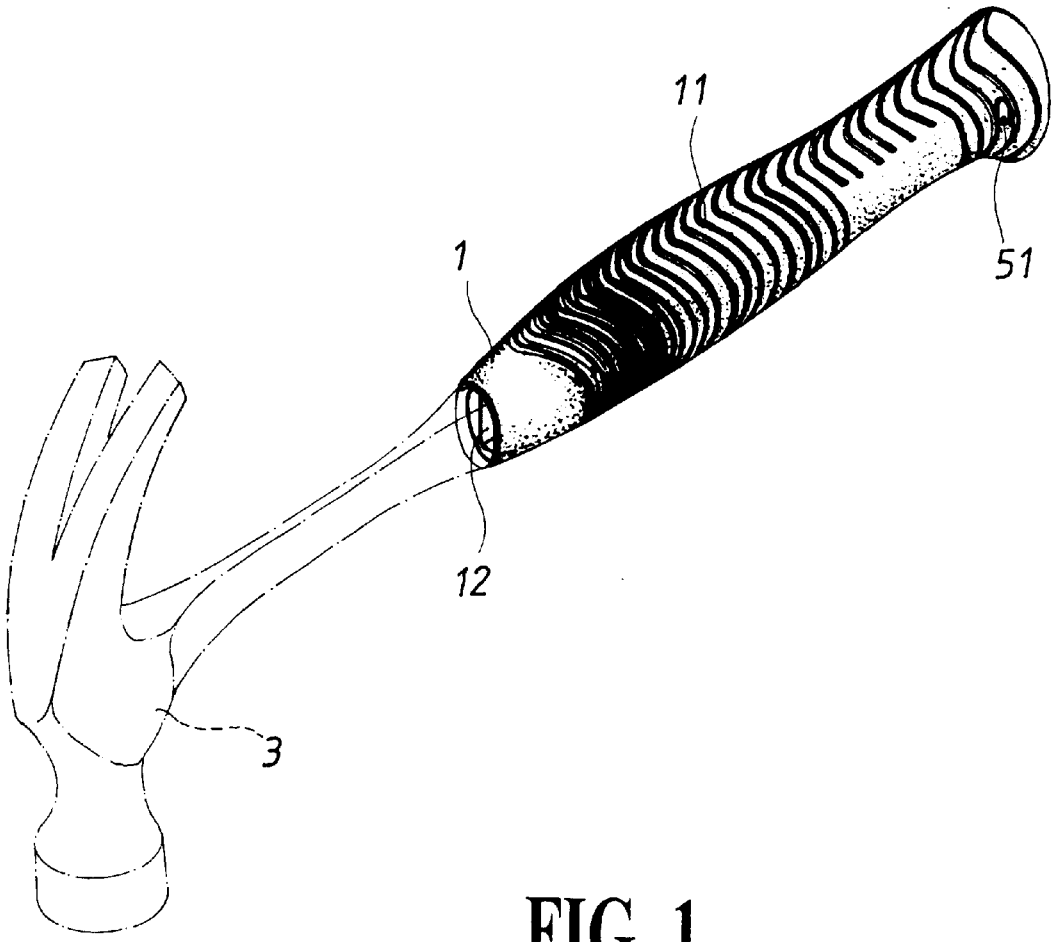
FIG. 1 is a perspective view of a shock absorbing handle grip according to the present invention.
Figure 2:
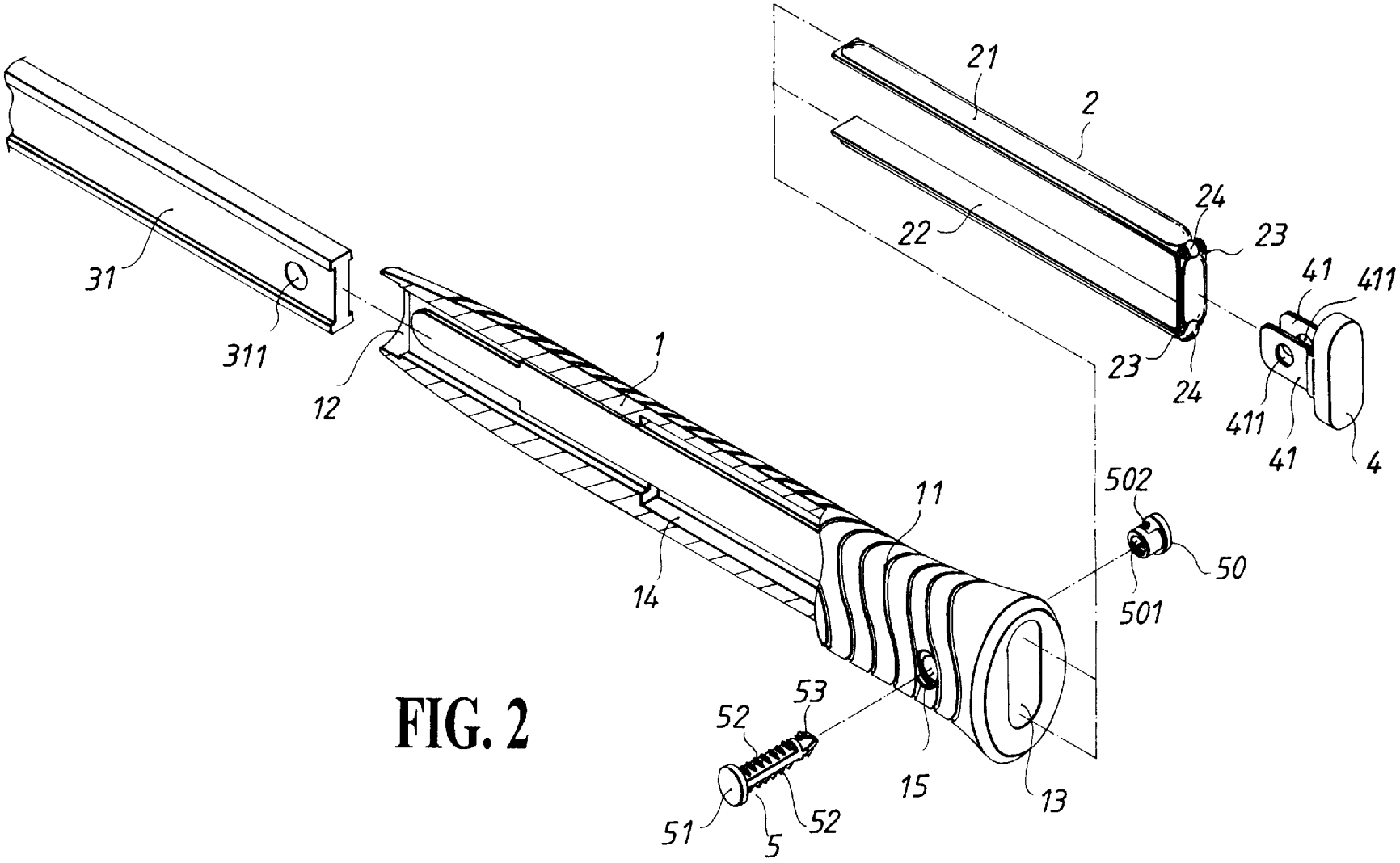
FIG. 2 is an exploded view of the present invention.

Referring to FIGS. 1 and 2, a shock absorbing handle grip in accordance with the present invention is comprised of a hollow, elongated grip body 1, a packing bar 2, and an end cap 4.

The grip body 1 is a sleeve member molded from rubber, having antiskid scoring lines 11 around the periphery for positive gripping of the hand, a longitudinal through hole 12 through front and rear ends thereof, which receives the coupling shaft 31 of the handle of the hand tool (for example, a hammer) 3, a rear end opening 13 at one end namely the rear end thereof in communication with the longitudinal through hole 12, which receives the end cap 4, two longitudinal sliding grooves 14 longitudinally disposed on the inside along two opposite sides of the longitudinal through hole 12, which receive the packing bar 2, and a transverse through hole 15 near the rear end. The packing bar 2 is a substantially U-shaped flat bar inserted from the rear end opening 13 into the longitudinal sliding grooves 14 of the grip body 1, comprising a transversely extended loop-like base 23 on the middle, two longitudinally extended flat arms 21;22 respectively perpendicularly extended from two opposite ends of the base 23 and respectively clamped on two opposite long sides of the coupling shaft 31, and two air vents 24 respectively provided at connection areas between the ends of the loop-like base 23 and the flat arms 21;22. The end cap 4 is plugged into the rear end opening 13 of the grip body 1 to seal the gap, having two parallel lugs 41 perpendicularly extended from a front side wall thereof, each lug 41 having a mounting hole 411.

Figure 3:
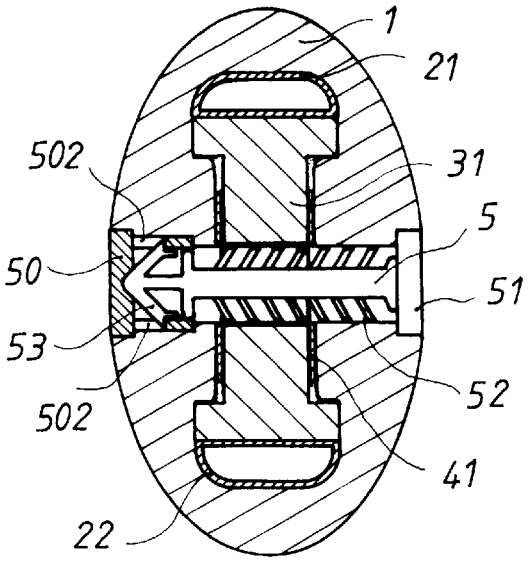
FIG. 3 is a transverse view in section of a part of the present invention, showing the split bolt and the holding down cap fastened to the grip body.
Figure 4:
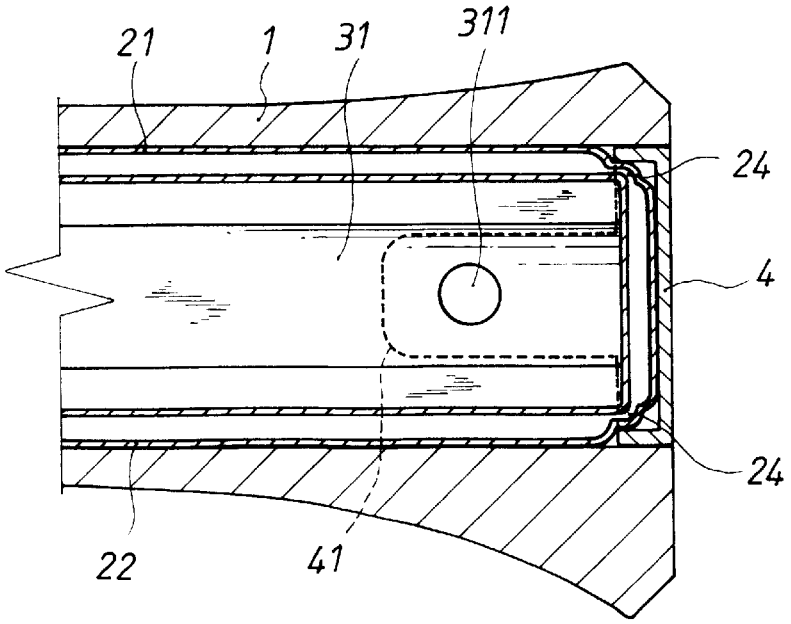
FIG. 4 is a longitudinal view in section of a part of the present invention, showing the end cap and the packing bar fastened to the coupling shaft.

Referring to FIGS. 3 and 4 and FIGS. 1 and 2 again, the coupling shaft 31 of the hand tool 3 has a coupling hole 311 near the end. When the coupling shaft 31 is inserted into the longitudinal through hole 12 of the grip body 1, the packing bar 2 is inserted through the rear end opening 13 into the longitudinal through hole 12 and stopped at the end of the coupling shaft 31 with the flat arms 21;22 clamped on two opposite long sides of the coupling shaft 31, then the end cap 4 is fastened to the rear end opening 13 of the grip body 1, enabling the lugs 41 to be inserted through the loop-like base 23 and closely attached to opposite side walls of the coupling shaft 31 and the mounting holes 411 to be aligned with the coupling hole 311 on the coupling shaft 31 and the transverse through hole 15 on the grip body 1, and then a split bolt 5 is inserted through the holes 15;411;311 and fastened up with a holding down cap 50 to fixedly secure the coupling shaft 31, the packing bar 2, the end cap 4 and the grip body 1 together.

Referring to FIGS. 2 and 3 again, the split bolt 5 comprises a head 51, a plurality of shank elements 52 perpendicularly extended from the head 51, and a plurality of hooked portions 53 respectively integral with the shank elements 52 at one end remote from the head 51. The holding down cap 50 comprises a cap body 501, which receives the shank elements 52, and a plurality of radial through holes 502. which receive the hooked portions 53 respectively. When the split bolt 5 is inserted through the holes 15;411;311. the receptacle portion 501 of the holding down cap 50 is coupled to the split bolt 5 outside the grip body 1, enabling the radial through holes 502 to be forced into engagement with the hooked portions 53 respectively to secure the split bolt 5 to the grip body 1 (see FIG. 4).

What the invention claimed is:

1. A shock absorbing handle grip comprising:

a rubber grip body coupled to the coupling shaft of a tool handle, said grip body comprising a longitudinal through hole through front and rear ends thereof, which receives the coupling shaft of the hand tool, a rear end opening at a rear end thereof, and two longitudinal sliding grooves longitudinally disposed on the inside along two opposite sides of said longitudinal through hole; and a substantially U-shaped flat packing bar inserted from the rear end opening into the longitudinal sliding grooves of said grip body and forming with said grip body an air bag around the coupling shaft of the tool handle, said packing bar comprising a transversely extended base stopped at one end of the coupling shaft of the tool handle, and two longitudinally extended flat arms respectively perpendicularly extended from two opposite ends of said base and respectively inserted into the longitudinal sliding grooves inside said grip body and respectively clamped on two opposite long sides of the coupling shaft of the tool handle.

2. The shock absorbing handle grip of claim 1 wherein said grip body has a plurality of antiskid scoring lines around the periphery.

3. A shock absorbing handle grip comprising:

a rubber grip body coupled to the coupling shaft of a tool handle, said grip body comprising a longitudinal through hole through front and rear ends thereof, which receives the coupling shaft of the hand tool, a rear end opening at a rear end thereof, and two longitudinal sliding grooves longitudinally disposed on the inside along two opposite sides of said longitudinal through hole;

a substantially U-shaped flat packing bar inserted from the rear end opening into the longitudinal sliding grooves of said grip body, said packing bar comprising a transversely extended base stopped at one end of the coupling shaft of the tool handle, and two longitudinally extended flat arms respectively perpendicularly extended from two opposite ends of said base and respectively inserted into the longitudinal sliding grooves inside said grip body and respectively clamped on two opposite long sides of the coupling shaft of the tool handle; and an end cap fastened to said grip body to seal said rear end opening, said end cap forming with said grip body and said packing bar an air bag around the coupling shaft of the tool handle.

4. A shock absorbing handle grip comprising:

a rubber grip body coupled to the coupling shaft of a tool handle, said grip body comprising a longitudinal through hole through front and rear ends thereof, which receives the coupling shaft of the hand tool, a rear end opening at a rear end thereof, two longitudinal sliding grooves longitudinally disposed on the inside along two opposite sides of said longitudinal through hole, and a transverse through hole near one end thereof adjacent to said rear end opening;

a substantially U-shaped-flat packing bar inserted from the rear end opening into the longitudinal sliding grooves of said grip body, said packing bar comprising a transversely extended base stopped at one end of the coupling shaft of the tool handle, and two longitudinally extended flat arms respectively perpendicularly extended from two opposite ends of said base and respectively inserted into the longitudinal sliding grooves inside said grip body and respectively clamped on two opposite long sides of the coupling shaft of the tool handle;

an end cap fastened to said grip body to seal said rear end opening, said end cap comprising two parallel, lugs respectively clamped on two opposite side walls of the coupling shaft of the tool handle, the lugs each having a hole aligned with a hole on the coupling shaft of the tool handle and the transverse through hole on said grip body; and fastening means fastened to the transverse through hole on said grip body, the hole on the coupling shaft of the tool handle and the holes on the lugs of said end cap to fixedly secure the coupling shaft of the tool handle, said end cap and said grip body together.

5. The shock absorbing handle grip of claim 4 wherein said packing bar comprises a plurality of air vents at the connection areas between two opposite ends of said transversely extended base and said longitudinally extended flat arms.

6. The shock absorbing handle grip of claim 4 wherein said fastening means comprises a split bolt inserted through the transverse through hole on said grip body, the hole on the coupling shaft of the tool handle and the holes on the lugs of said end cap, and a holding down cap fastened to said split bolt to secure said split bolt to said grip body, said split bolt comprising a head stopped outside said grip body at one end of the transverse through hole on said grip body, a plurality of shank elements respectively extended from said head and inserted through the transverse through hole on said grip body, the hole on the coupling shaft of the tool handle and the holes on the lugs of said end cap, and a plurality of hooked portions respectively integral with said shank elements at one end and disposed outside said grip body, said holding down cap comprising a receptacle portion which receives said hooked portions and a part of each of said shank elements of said split bolt, and a plurality of radial through holes respectively forced into engagement with said hooked portions of said split bolt.

* * * * *